United States Patent [19]

Smith et al.

[11] 4,086,007

[45] Apr. 25, 1978

[54] DUAL PURPOSE DOCUMENT AND COPY SHEET FEED CASSETTE

[75] Inventors: Craig A. Smith, Pittsford; Clifford L. George, Macedon, both of N.Y.

[73] Assignee: Xerox Corporation, Stamford, Conn.

[21] Appl. No.: 737,302

[22] Filed: Nov. 1, 1976

[51] Int. Cl.[2] ..... B65H 29/22; G03G 15/28

[52] U.S. Cl. ..... 355/3 R; 271/4; 355/8

[58] Field of Search ..... 355/11, 66, 8, 47, 48, 355/49, 50, 51, 75, 14, 3 R; 271/9, 19, 21, 4; 226/74, 109

[56] References Cited

U.S. PATENT DOCUMENTS

| | | | |
|---|---|---|---|
| 3,804,514 | 4/1974 | Jasinski | 355/75 |
| 3,840,222 | 10/1974 | Fowlie et al. | 271/4 |
| 3,858,777 | 1/1975 | Rodek | 226/109 X |
| 3,877,804 | 4/1975 | Hoppner | 355/8 |
| 3,973,846 | 8/1976 | Sullivan et al. | 355/3 R |
| 3,989,236 | 11/1976 | Komori et al. | 271/4 |

FOREIGN PATENT DOCUMENTS

| | | | |
|---|---|---|---|
| 932,441 | 7/1963 | United Kingdom | 271/4 |

*Primary Examiner*—Donald A. Griffin
*Attorney, Agent, or Firm*—James J. Ralabate; Clarence A. Green; Paul Weinstein

[57] ABSTRACT

A dual purpose removable cassette for a reproducing apparatus is provided, as well as a reproducing apparatus employing the cassette. The cassette is adapted to support both a supply of copy sheet material in the form of a fan-fold web as well as an extra long document which may be in either a coiled form or a fan-fold form.

20 Claims, 5 Drawing Figures

DUAL PURPOSE DOCUMENT AND COPY SHEET FEED CASSETTE

BACKGROUND OF THE INVENTION

The invention relates to a dual purpose removable cassette for a reproducing apparatus. The invention also comprises a reproducing apparatus employing such a cassette for copying extra long documents. The cassette is adapted to support both a supply of copy sheet material in the form of a fan-fold web as well as an extra long document in either a coiled form or a fan-fold web form.

Reproducing apparatus are known in the art which are capable of handling both web-type originals or documents and web-type copy sheets. An example of such a system is that described in U.S. Pat. No. 3,076,392, to Cerasani et al.

Reproducing apparatuses including systems for forming copy images on a web-type copy sheet in fan-fold form are also known in the art as exemplified by U.S. Pat. No. 3,973,846, to Sullivan et al.

Reproducing apparatuses for imaging fan-fold type original documents are known as exemplified by U.S. Pat. No. 3,804,514 to Jasinski. Computer printers also form printed images on fan-fold web-type sheet material. One such system, the IBM 3800 computer printer, uses a xerographic process for printing on such a fan-fold web.

Various copying machines such as the Xerox 3100 LDC copier are known in the art which are capable of copying long originals on equally long copy sheets. Conventionally, the length of the copy sheet is limited by the length of a removable cassette used to supply it to the image transfer station. A machine of this general type is exemplified by U.S. Pat. No. 3,877,804 to Hoppner.

It is known that with a Xerox 3100 LDC copier it is possible to manually handle copy sheets which exceed the length of a cassette fed sheet in order to copy extra long documents many feet in length. This manual handling approach has been accomplished by inserting the lead edge of an extra long copy sheet into the cassette so that it may be fed to the image transfer station. Similarly, the extra long document is inserted in the document feeding head. The copy sheet and document are then fed in synchronism to form the extra long copy.

As noted above, the use of a copy sheet cassette is well known in the art. U.S. Pat. No. 3,767,187 to Mahler is illustrative of such a removable cassette which can be employed in a machine such as the Xerox 3100 LDC copier. In the Xerox 3100 LDC copier, multiple cassettes are provided including a longer cassette for handling longer copy sheets. However, the essential features of the cassette shown in this patent are shared by the extra long paper cassette.

Many documents or originals which are generated are of an extra long character. For example, strip chart recorders often generate documents many feet in length. Reproduction of such document has been extremely difficult in the past even when carried out by the manual handling approach described above with reference to the Xerox 3100 copier.

SUMMARY OF THE INVENTION

In accordance with the present invention a dual purpose removable cassette and a reproducing apparatus employing such a cassette are provided which will simplify the copying of extra long documents up to many feet in length. The cassette is adapted to handle both a web-type copy sheet and a web-type document. In the preferred embodiments, the web-type copy sheet is in a fan-fold form and the document may be either in a fan-fold form or in a coiled form.

The removable cassette of this invention includes means for supporting a supply of copy sheet material in web form for feeding to the imaging means of a reproducing apparatus as well as means for supporting a document in web form for feeding to the exposure means of the apparatus. In a preferred embodiment the means for supporting the document includes means for supporting a document in fan-fold form or in the form of a coiled sheet. Preferably, a fan-fold web feeding guide means operates to maintain registration of the folded sheet on the document support means.

The reproducing apparatus in accordance with this invention includes the removable cassette described above. An imaging means is provided for forming the image on the copy sheet. The imaging means includes a photosensitive surface. An exposure means is provided for receiving the document and for projecting an image thereof onto the photosensitive surface.

Accordingly, it is an object of the present invention to provide an improved removable dual purpose copy sheet and original document feeding cassette for a reproducing apparatus.

It is a further object of this invention to provide a reproducing apparatus capable of copying extra long documents.

It is a still further object of this invention to provide a reproducing apparatus as above employing the above dual purpose copy sheet and document feeding cassette.

These and other objects will become apparent from the following description and drawings.

DETAILED DESCRIPTION OF THE PREFERRED EMBODIMENTS

The invention will now be described by reference to a preferred embodiment of a dual purpose copy sheet and document feed cassette in accordance with this invention as well as an exemplary reproducing apparatus employing the cassette. The dual purpose cassette of the present invention in the embodiment which will be described is employed in a reproducing machine of the type set forth in the above-identified patent to Hoppner. Additional details of such a machine can be found in the commercially available Xerox 3100 LDC copier. While the dual purpose casssette will be described with reference to that specific machine, it may be employed with any desired reproducing apparatus.

While the cassette will be shown with reference to a machine of the type wherein exposure of the document is provided by moving original type exposure, the invention is not limited thereto. The document feeding portion of the cassette of this invention could be employed with a stationary original exposure system, for example, of the type described in the above-identified patent to Jasinski.

Figure 1:
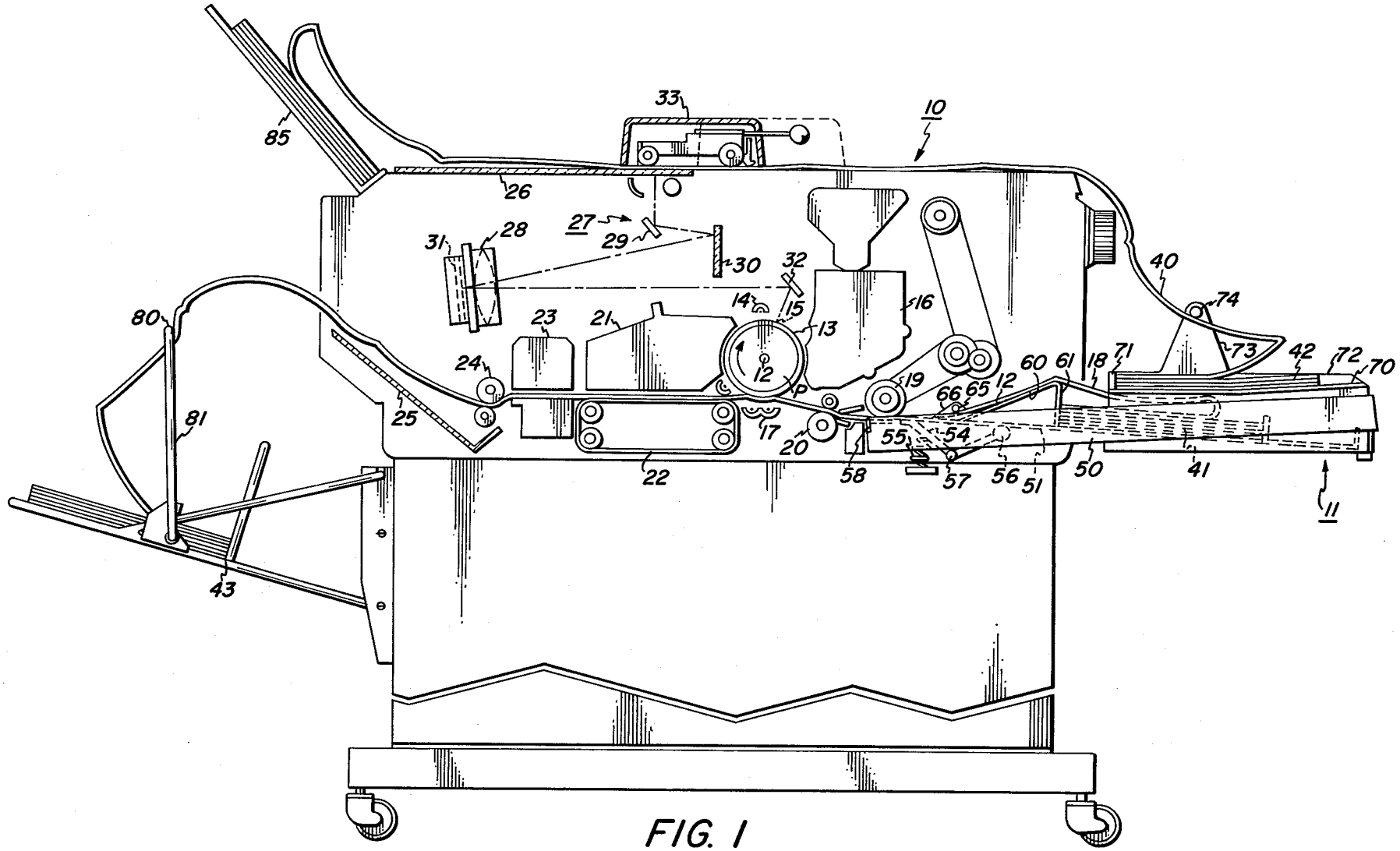
FIG. 1 is a schematic view of a reproducing apparatus in accordance with the present invention.

Referring now to FIG. 1, there is shown by way of example an electrostatographic reproducing machine 10 which incorporates the dual purpose cassette apparatus 11 of the present invention. The reproducing machine 10 depicted in FIG. 1 illustrates the various components utilized therein for xerographically producing copies from an original. Although the apparatus of the present invention is particularly well adapted for use in an automatic xerographic reproducing machine 10, it should become evident from the following description that it is equally well suited for use in a wide variety of reproducing apparatuses and is not necessarily limited in its application to the particular embodiment shown herein.

Basically, the xerographic processor includes a rotatably mounted photoconductive drum P which is supported upon a horizontally extended shaft 12. The drum is driven in the direction indicated whereby its photoconductive surface 13 is caused to pass sequentially through a series of xerographic processing stations.

The practice of xerography is well-known in the art, and is the subject of numerous patents and texts, including *Electrophotography* by Schaffert, published in 1965, and *Xerography and Related Processes,* by Dessauer and Clark, published in 1965. Therefore, the various processing steps involved will be briefly explained below in reference to FIG. 1. Initially, the photoconductive drum surface 13 is uniformly charged by means of a corona generator 14 positioned within a charging station located at approximately the 12 o'clock drum position. The charged drum surface 13 is then advanced into an imaging station 15 wherein a flowing light image of an original document to be reproduced is projected onto the charged drum surface thus recording on the drum a latent electrostatic image containing the original input scene information. Next, subsequent to the exposure step in the direction of drum rotation is a developing station 16 wherein the latent electrostatic image is rendered visible by applying an electroscopic marking powder (toner) to the photoreceptor surface in a manner well known and used in the art. The now visible image is then forwarded into a transfer station 17 wherein a sheet of final support material 18 is brought into contact with the toner image and the image transferred from the surface 13 to the support sheet 18 by means of the corona generator 17.

In operation, the copy sheet is supported within the machine 10 by means of a cassette 11 of this invention. A pair of feed rollers 19 are arranged to operatively engage the sheet in the cassette so as to advance it into the nip of registration rollers 20 which advance it to the transfer station 17 in synchronous moving relationship to the developed image on the photoconductive plate surface 13. The motion of the rollers 20 is coordinated with that of the rotating drum surface, as well as the other machine components through the main drive system whereby the support sheet is introduced into the transfer station in proper registration with the developed toner image supported on the xerographic plate. For further information concerning this type of sheet feeding mechanism, reference may be had to U.S. Pat. No. 3,731,915 to Guenther.

After transfer, but prior to the reintroduction of the imaged portion of the drum into the charging station 14, the plate surface is passed through a cleaning station 21 wherein the residual toner remaining on the plate surface 13 is removed. The removed toner particles are collected within a container where they are stored subject to periodic removal from the machine.

Upon completion of the image transfer operation, the toner bearing support sheet is stripped from the drum surface and placed upon a moving vacuum transport 22 which serves to advance the support sheet into a thermal fusing station 23 wherein the toner image is permanently fixed to the sheet 18. The copy sheet 18 with the fused image thereon is forwarded by output rolls 24 from the fuser 23 to a collecting tray 25 where the sheet is held until such time as the operator has occasion to remove it from the machine.

Normally, when the copier is operated in a conventional mode, the original document to be reproduced is placed image side down upon a horizontal transparent viewing platen 26 and the stationary original then scanned by means of the moving optical system 27. The scanning system 27 fundamentally consists of a lens 28 positioned below the right hand margin of the platen as viewed in FIG. 1, and a pair of cooperating movable scanning mirrors 29 and 30. The lens is basically a half-lens objective having a reflecting surface 31 at the stop position to simulate a full lens system. The two mirrors are slidably supported between a pair of parallel horizontally aligned guide rails (not shown). For a further description and greater details concerning this type of optical scanning system reference is had to U.S. Pat. No. 3,832,057 to Shogren.

In practice, mirror 29, herein referred to as the full rate scan mirror, is caused to move from a home position, directly below the left hand margin of the platen to an end of scan position below the opposite margin of the platen. The rate of travel of the scan mirror is synchronized to the peripheral speed of the rotating xerographic drum surface P. The second mirror 30 is simultaneously caused to move in the same direction as the scanning mirror at half the scanning rate. As the two mirrors sweep across the platen surface, an image of each incremental area thereon viewed by the scanning mirror is reflected towards the second mirror which, in turn, redirects the image back to the half lens system. The reflecting surface, positioned at the lens stop position, reverses the entering light rays and redirects the light rays back towards a stationary mirror 32 positioned directly above the drum surface at exposure station 15. In this manner a flowing light image of the original input scene information is projected onto the charged photoconductive surface 13.

A wind up spring (not shown) is provided to restore the moving mirrors to a start of scan condition.

The copying apparatus 10 shown in FIG. 1 is provided with a document feeder 33. The document feeder 33 is movable between a first stored position adjacent to the viewing platen 26 (shown in phantom) and a second operative position over the platen surface. Commensurate with the positioning of the feeder assembly over the platen, the moving optical system 27 is locked in a position to view a document as it is advanced by the document feeder over the platen and record a flowing light image of the input information upon the moving photoconductive plate surface 13.

During normal operations, that is, when the moving optics are utilized to provide a flowing light image of the stationary original, the document feeding assembly is maintained in a stored position (as depicted by the phantom lines shown in FIG. 1) to expose the entire platen suface area and thus provide a maximum working area for the operator. To condition the machine 10 for the moving document mode of operation, the machine operator simply advances the document feeding assembly 33 from the stored position to a document feeding position with the feeding assembly extending over the left hand margin of the platen surface.

For copying conventional documents a sheet feeding cassette of the type described in the above-identified patent to Mahler is employed in the apparatus 10. The Mahler cassette supports a stack of individual sheets which are separated and fed by rolls 19.

For copying extra long web-type documents of this invention the dual purpose cassette 11 is employed. It is adapted to support the web-type document 40 as well as a web-type copy sheet 18. The copy sheet 18 as supplied is folded in zig-zag fashion to provide a fan fold-stack 41. The extra long document may be provided as a fan-fold stack 42 or in coiled form as in FIG. 5. The extra long copy sheet web 18 is not stacked in the output tray 25. Instead it is fed out of the machine 10 and folded and stacked on output tray 43.

Figures 2, 5:
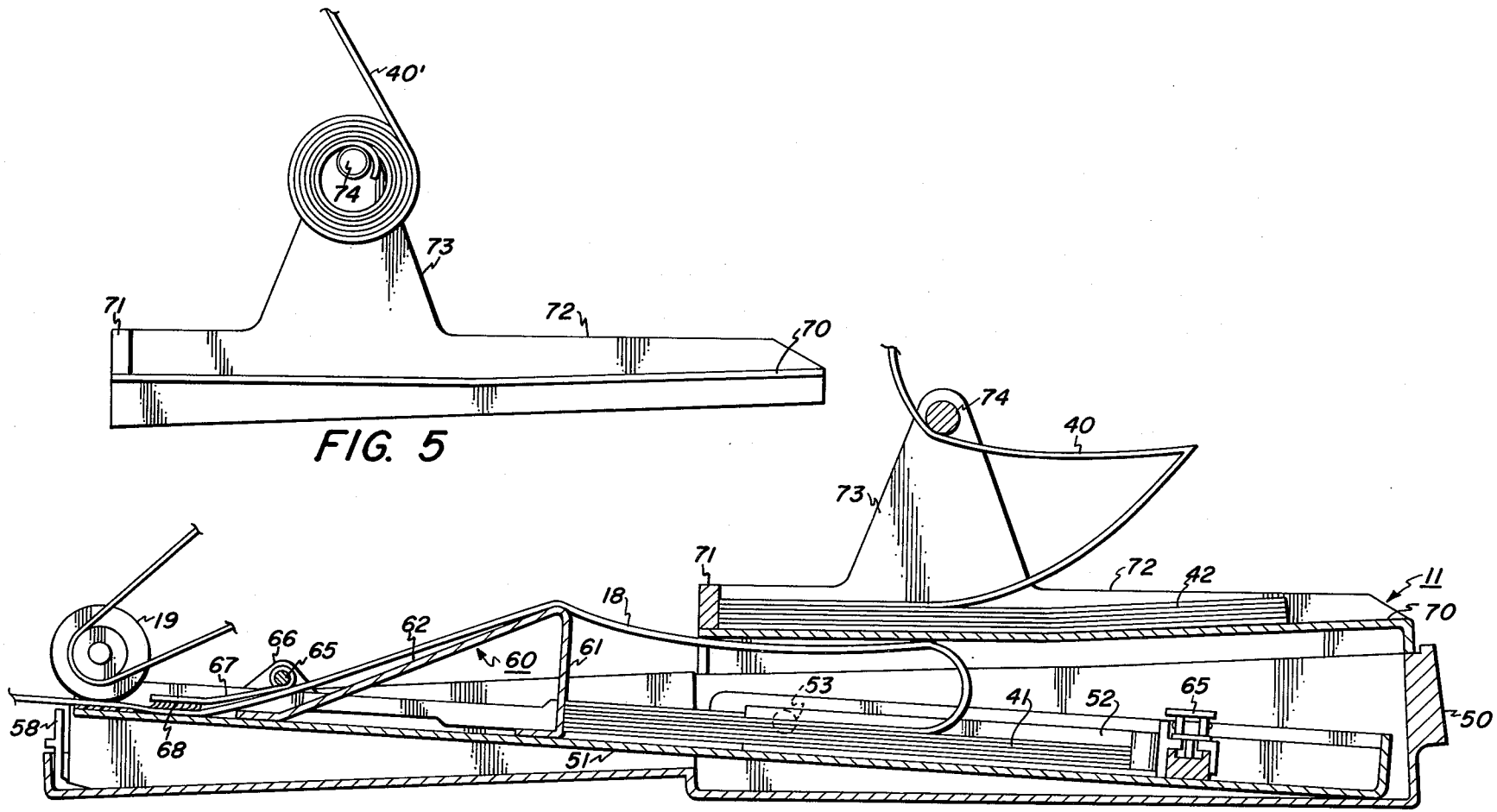
FIG. 2 is a cross-sectional view of the dual purpose copy sheet and document feeding cassette shown in FIG. 1.
FIG. 5 is a partial side view of a document support portion of the dual purpose cassette of this invention shown as employed for supporting a coiled type document.
Figure 3:
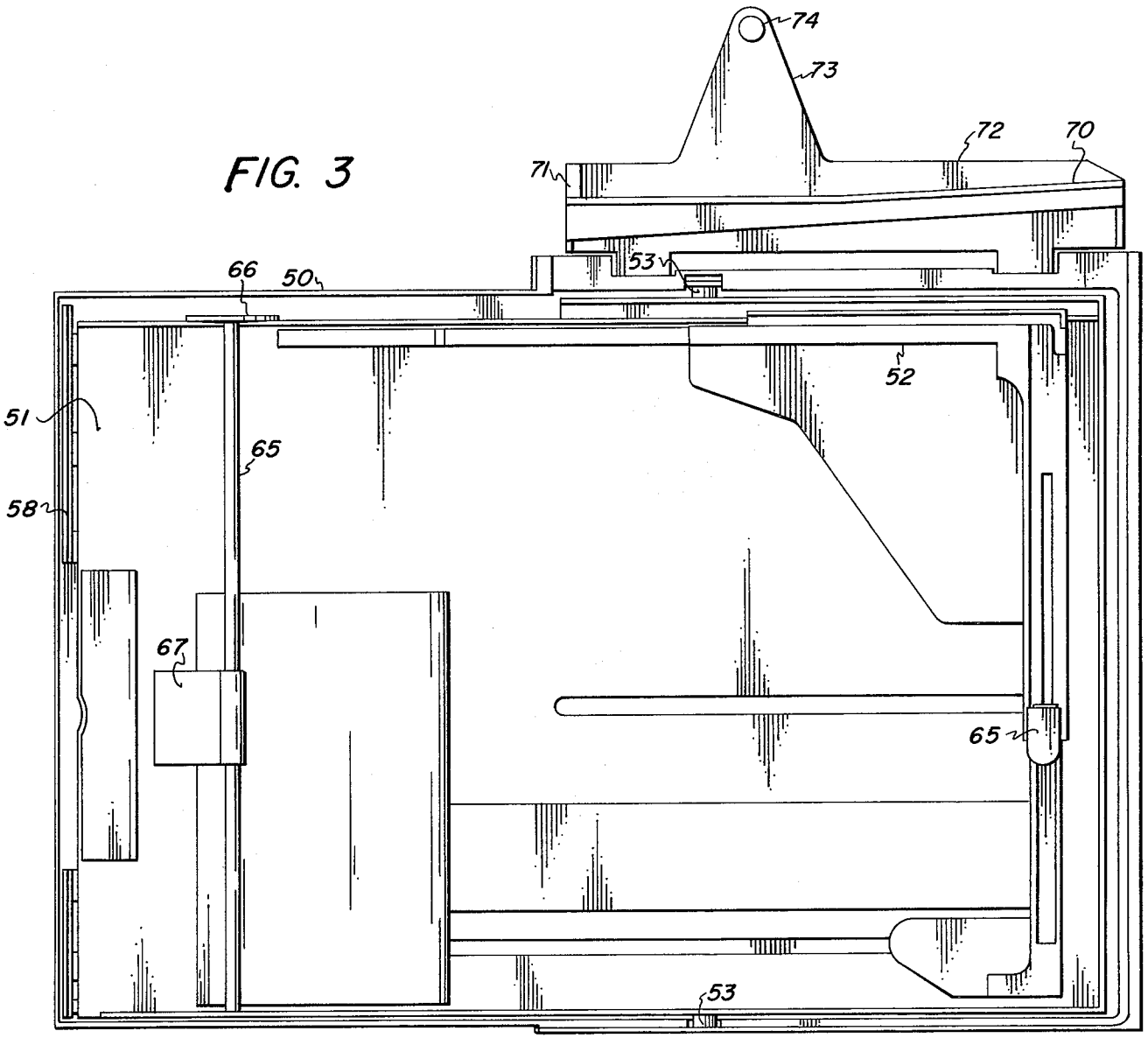
FIG. 3 is a top view of the dual purpose cassette shown in FIG. 1 with the document support portion pivoted up to show the underlying copy sheet support portion.
Figure 4:
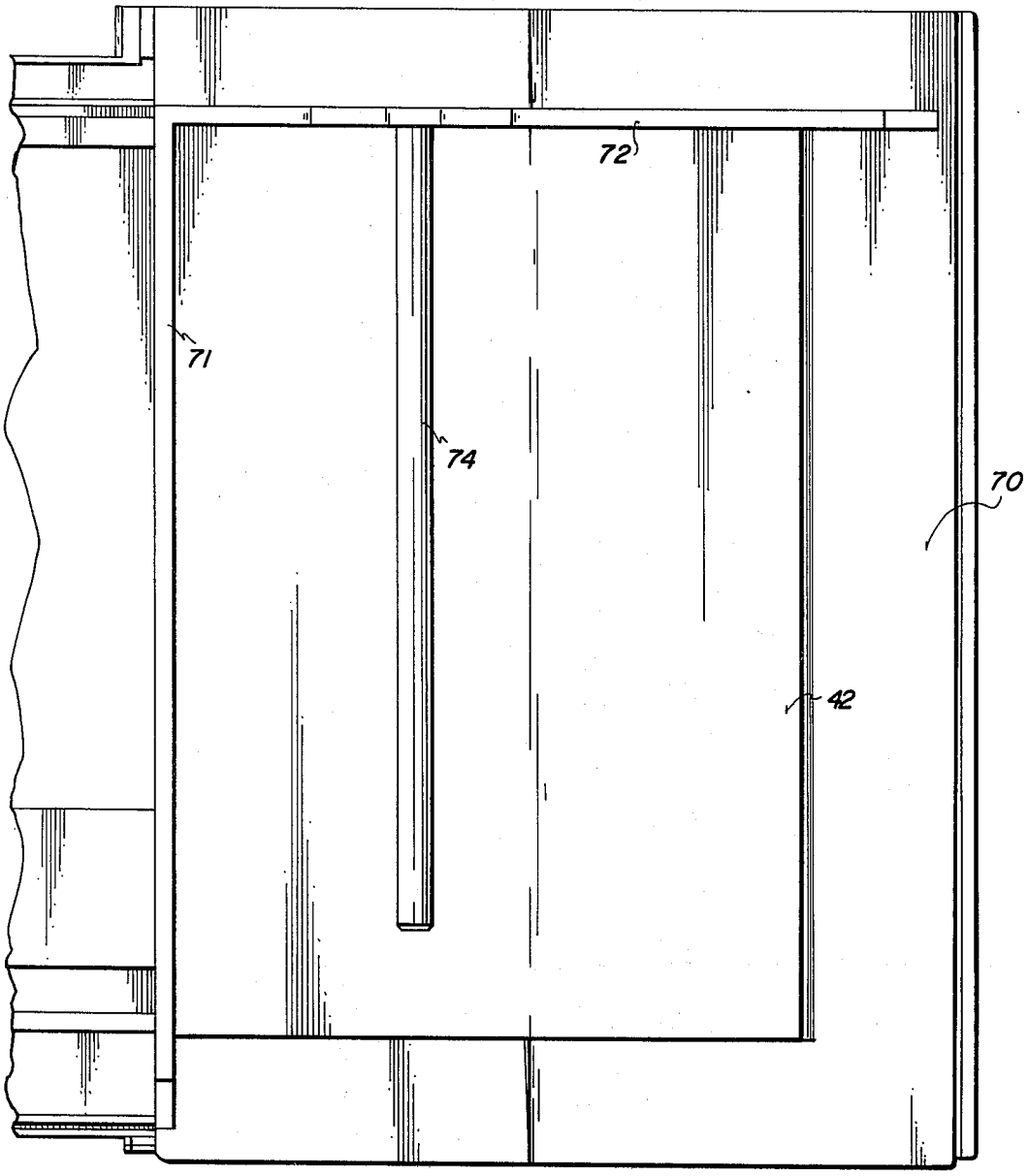
FIG. 4 is a top view of the document support portion of the dual purpose cassette shown in FIG. 1.

Referring now to FIGS. 1 through 3, the dual purpose document and copy sheet feed cassette 11 will be described in greater detail. Some elements of the cassette 11 are essentially the same as those employed in the large document cassette of the Xerox 3100 LDC copier and similar to those employed in the Mahler patented cassette. Exemplary of such elements are the frame 50, the pivoting bottom stack support plate 51, and the sheet size adjustable side and rear stack edge guide 52. The bottom plate 51 of the cassette 11 is pivoted in the frame 50 by means of studs 53. The bottom plate 51 is pivoted so that the sheet 18 supported on it may be urged against the feed rolls 19 for feeding into the machine. This is accomplished by means of a pivotally supported member 54 which is biased by a spring 55 against the bottom plate 51. A handle 56 connected to the shaft 57 pivotally supporting member 54 is utilized to latch and unlatch the pivotal member. In its operative position the member 54 biases the bottom plate 57 against the feed rolls 19. In its inoperative position the member 54 is withdrawn from engagement with the bottom plate 51 so that the cassette 11 may be readily removed from the machine 10.

A suitable sheet feeding apparatus with which the cassette 11 in accordance with the present invention could be employed is described in detail in U.S. Pat. No. 3,731,915 to Guenther, and as indicated above, it could be employed with a sheet feeding apparatus of the type utilized in the Xerox 3100 LDC copier. Since the details of the mechanisms for receiving the cassette 11 and for urging the bottom plate 51 against the feed rolls 19 form no part of the present invention, they need not be described in detail. Reference may be had to the Xerox 3100 LDC copier or to the above-identified Guenther patent for further details with respect to those mechanisms.

Having thus described the elements of the cassette shown in FIG. 1 through 3, which are common to the commercially available 3100 LDC cassette, attention will now be drawn to the modifications which have been made to such a cassette in order to transform it into a dual purpose cassette 11 of this invention for handling both copy sheet and document originals. In the 3100 LDC cassette, the front end 58 of the cassette is utilized for registration of the lead edge of the copy sheet stack. In the cassette 11 of this invention a support member 60 for the lead edge of the fan-fold stack 41 is mounted on the pivoting bottom plate 51 upstream of the front end 58 of the cassette. Lead edge support for the stack 41 is provided by the vertical surface 61 of the member 60. The support member 60 also has an inclined guide surface 62 extending forwardly and downwardly of the vertical surface 61. The two surfaces 61 and 62 are joined by a rounded guide surface.

The height of the support surface 61 from the bottom plate is deliberately made greater than the height of the stack of fan-folded copy sheet 41 supported in the cassette. If the height of the support surface 61 were the same as or less than the height of the stack 41, it would be difficult to feed the fan-fold sheet in opposition to a fold in the plane of the stack because the beam strength of the sheet would oppose continued feeding. By making the guide surface 61 higher than the top of the stack 41, the sheet is pulled at an angle to the plane of the stack, thereby reducing any opposition to continued feeding. The fan-fold stack 41 of copy sheet material, which may be paper, plastic, or other desired material, is supported on the pivoting bottom plate 51 with its lead edge against the support surface 61. The adjustable side or rear corner guide 52 is then adjusted to the size of the stack and then locked in place by lock lever 65. In order to prepare the fan-fold stack 41 for feeding, the lead edge of the sheet 18 is threaded over the guide member 60 and under a guide shaft 65 supported by vertically extending tabs 66 mounted on the bottom plate 51. The guide shaft 65 serves to guide the copy sheet down to the level of the botton plate 51. The lead edge of the copy sheet 18 is placed against the front plate 58 of the cassette 11.

To hold the lead edge of the sheet 18 in place, a hold-down member 67 is provided which is pivoted about shaft 65 and against the sheet 18 and the bottom plate 51. The hold-down member 67 includes a brush-like pad 68 which engages the sheet 18. The fibers of the brush pad 68 are angled in the direction of feeding so that it is easy to move the sheet in the feeding direction. If one attempts to move the sheet 18 in the opposing direction, however, the fibers of the pad 68 resist such motion. In operation the bottom plate 51 biases the sheet 18 against the feed rolls 19 so the sheet can be fed into the machine 10.

Referring now to FIGS. 1 through 4, the document 40 support section of the dual purpose cassette 11 of this invention will be described in detail. The document 40 can be in a fan-fold form or in a coiled or rolled up form. Irrespective of its form, it is supported upon cover plate 70 of the cassette 11 which is pivotally mounted to the frame 50. Front 71 and side 72 guide members are mounted on the cover plate 70 for supporting the front and side edges of the document stack 42. When the cassette 11 is inserted in the machine 10, the side guide 72 is aligned with the registration guide (not shown) for the document feeder 33.

An extension 73 of the side guide 72 supports a shaft 74 which serves a dual purpose. For a roll or coiled type original document 40' the shaft 74 is utilized to support the document as in FIG. 5. If it is desired to feed a fan-folded web-type document 40, then the shaft 74 serves as a sheet feeding guide as in FIG. 2. The shaft 74 is arranged so that when the document 40 is fed between the shaft and the reproducing apparatus 10, the shaft acts on the document 40 to urge the document stack 42 against the front guide member 71. Therefore, as the document 40 is fed and the fan-fold stack 42 is depleted, the guide member 74 prevents the stack from moving off the support plate 70.

Referring again to FIG. 1, a fan-fold copy sheet web 18 and a fan-fold original document web 40 are employed. The fan-fold copy sheet web 18 has been inserted in the cassette 11 in the manner described above. It is fed through the reproducing apparatus 10 along the sheet feed path. The copy sheet exits from the reproducing machine 10 and is stacked in fan-fold fashion in the output tray 43. The output tray 43 includes "U" shaped guide member 80 which is inverted and the arms 81 attached to the tray 43. The guide member 80 aids in folding the web 18 as it exits from the reproducing machine so that it will stack properly.

The document 40 is fed between the guide shaft 74 and the reproducing apparatus 10 over the top surface of the reproducing apparatus, through the document feeding head 33 and then to a collecting tray 85 which is inclined upwardly. The inclined collecting tray 85 extends upwardly from the path of the document 40 through the head 33 in order to cause the fan-fold document to fold and stack properly.

To start operation the cassette 11 with the copy sheet therein is placed in the reproducing apparatus. The document 40 is then placed on the cassette plate 70. Copying commences when the document 40 is inserted in the document feeding head 33. A sensing switch (not shown) as in the 3100 LDC copier is supported in the document feeding head 33 and acts as a start-print button. Upon sensing the lead edge of the document, the switch causes the copying sequence to be programmed in a conventional manner including the feeding of the copy sheet. The feeding of the copy sheet 18 and the document 40 continue until the document exits from the document feeder 33. After the document exits the document feeder, the machine proceeds to shut-down in a conventionally timed sequence. Upon shut-down the feeding of the copy sheet ceases. By choosing a copy sheet which is the same length as the document the entire copy sheet will exit from the copier before the machine shuts down.

Roll form documents 40' are rolled up against collecting tray 85 with operator assistance.

The patents and texts referred to specifically in detailed description of this application are intended to be incorporated by reference into the description.

It is apparent that there has been provided in accordance with this invention a dual purpose document and copy sheet feed cassette which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A dual purpose document and copy sheet feed cassette apparatus for supplying said document and said copy sheet to an exposure station and an imaging station, respectively, of a reproducing machine, said apparatus comprising:

a frame;

means connected to said frame for supporting said document for feeding to said exposure station;

means connected to said frame for supporting said copy sheet for feeding to said imaging station;

said document comprising a web-type document and said copy sheet comprising a web-type copy sheet, said web-type copy sheet comprising a fan-fold stack;

said means for supporting said copy sheet further including guide means for supporting a lead edge of said fan-fold copy sheet stack, said guide means extending above the top level of said copy sheet stack, whereby resistance to feeding caused by a fold in the plane of the stack is substantially reduced;

said copy sheet support means further including a bottom member pivotally supported on said frame, said guide means extending upwardly from said bottom member and being located upstream of a front portion of said cassette apparatus, said copy sheet support means further including means for guiding said sheet as it is unfolded from said stack downwardly towards said bottom member.

2. An apparatus as in claim 1, wherein said means for supporting said document includes means for supporting a document comprising a fan-folded sheet stack and means for supporting a document comprising a coiled sheet.

3. An apparatus as in claim 2, wherein said means for supporting a document comprising a fan-fold sheet comprises a bottom support member for supporting said document stack, means for supporting and aligning a front edge of said document stack on said bottom support member and means for supporting and aligning a side edge of said document stack on said bottom support member.

4. An apparatus as in claim 3 wherein said means for supporting said document comprising a coiled sheet comprises a coiled document support member, said member being positioned above said fan-fold stack bottom support member and extending across it in a direction transverse to the direction in which said document is to be fed, said support member comprising an elongated element insertable into a core of a coiled document for supporting the coiled document for supporting the coiled document so that it can be unwound and fed to said exposure station.

5. An apparatus as in claim 4, wherein said document support member also comprises a means for guiding a fan-fold document as it is fed to said exposure station so that the guiding engagement of said document support member with said document urges said stack against said means for supporting said front edge of said stack.

6. An apparatus as in claim 1, wherein said copy sheet support means includes:

means for resisting movement of said sheet in a direction opposed to the direction in which it is to be fed, said means for opposing movement of said sheet being biased against said sheet and said bottom member.

7. An apparatus as in claim 1, wherein said document support means is located above said copy sheet support means.

8. An apparatus as in claim 7 wherein said document support means is pivotally secured to said frame so that it may be pivoted away from said copy sheet support means to provide access to said copy sheet.

9. In a reproducing apparatus including:

means for forming an image on a sheet of material, said image forming means including a photosensitive surface;

exposure means for viewing a document and for projecting an image thereof onto said photosensitive surface;

means for feeding said document to said exposure means; and a cassette including a frame and means connected to said frame for supporting a supply of sheet material for feeding to said image forming means, said cassette and frame being arranged to be removable from said apparatus;

the improvement wherein said cassette further includes means connected to said frame for supporting said document for feeding to said exposure means;

whereby removal of said cassette from said apparatus removes both said means for supporting said supply of sheet material for feeding to said imaging means and said means for supporting said document for feeding to said exposure means from said apparatus.

10. An apparatus as in claim 9, wherein said document comprises a web-type document and said copy sheet comprises a web-type copy sheet, said web-type copy sheet comprising a fan-fold stack.

11. An apparatus as in claim 10, wherein said means for supporting said document includes means for supporting a document comprising a fan-folded sheet stack and means for supporting a document comprising a coiled sheet.

12. An apparatus as in claim 11, wherein said means for supporting a document comprising a fan-fold sheet comprises a bottom support member for supporting said document stack, means for supporting and aligning a front edge of said document stack of said bottom support member and means for supporting and aligning a side edge of said document stack on said bottom support member.

13. An apparatus as in claim 12, wherein said means for supporting said document comprising a coiled sheet comprises a coiled document support member, said member being positioned above said fan-fold stack bottom support member and extending across it in a direction transverse to the direction in which said document is to be fed, said support member comprising an elongated element insertable into a core of a coiled document for supporting the coiled document so that it can be unwound and fed to said exposure station.

14. An apparatus as in claim 13, wherein said document support member also comprises a means for guiding a fan-fold document as it is fed to said exposure station so that the guiding engagement of said document support member with said document urges said stack against said means for supporting said front edge of said stack.

15. An apparatus as in claim 10, wherein said means for supporting said copy sheet further includes guide means for supporting a lead edge of said fan-fold copy sheet stack, and wherein said guide means extends above the top level of said copy sheet stack, whereby resistance to feeding caused by a fold in the plane of the stack is substantially reduced.

16. An apparatus as in claim 15, wherein said copy sheet support means comprises a bottom member pivotally supported on said frame and wherein said guide means extends upwardly from said bottom member and is located upstream of a front portion of said cassette apparatus, said copy sheet support means further including means for guiding said sheet as it is unfolded from said stack downwardly towards said bottom member.

17. An apparatus as in claim 16, wherein said copy sheet support means includes;

means for resisting movement of said sheet in a direction opposed to the direction in which it is to be fed, said means for opposing movement of said sheet being biased against said sheet and said bottom member.

18. An apparatus as in claim 10, wherein said document support means is located above said copy sheet support means.

19. An apparatus as in claim 18, wherein said document support means is pivotally secured to said frame which also supports said copy sheet support means so that it may be pivoted away from said copy sheet support means to provide access to said copy sheet.

20. An apparatus as in claim 19, wherein said exposure means exposes said document as it is fed by said feeding means and wherein said photosensitive surface is arranged for movement and wherein said feeding means moves said document in coordination with the movement of said photosensitive surface.

* * * * *